United States Patent [19]

Nordmann

[11] 3,938,421

[45] Feb. 17, 1976

[54] RAMMER FOR PROJECTILES

[75] Inventor: Adolf Nordmann, Hochdahl, Germany

[73] Assignee: Rheinmetall GmbH, Dusseldorf, Germany

[22] Filed: Apr. 11, 1974

[21] Appl. No.: 460,138

[30] Foreign Application Priority Data

Apr. 21, 1973 Germany ..... 2320398

[52] U.S. Cl. ..... 89/47

[51] Int. Cl.[2] ..... F41F 17/16

[58] Field of Search ..... 89/33 A, 33 B, 45, 46, 89/47

[56] References Cited

UNITED STATES PATENTS

| | | | |
|---|---|---|---|
| 760,158 | 5/1904 | Schneider | 89/45 |
| 1,753,850 | 4/1930 | Courseulles | 89/45 |
| 3,120,785 | 2/1964 | Lorimer et al. | 89/47 |

*Primary Examiner*—Stephen C. Bentley
*Attorney, Agent, or Firm*—Ernest G. Montague; Karl F. Ross; Herbert Dubno

[57] ABSTRACT

A ramming device for shells by means of which the kinetic energy necessary for free flight through a Chamber of a gun is imparted to a shell having a base. The device comprises a ramming lever engaging behind the base of said shell and adapted to be driven in a swinging motion around a pivot point. The latter is guided in turn over a circular path such that the end of said lever which acts on said shell passes along an at least approximately linear path parallel to the axis of the bore of a barrel of said gun.

5 Claims, 3 Drawing Figures

RAMMER FOR PROJECTILES

The present invention relates to a rammer for projectiles.

For firing rounds of ammunition which are intended to be loaded individually, as is the case with large caliber guns, the projectile must be pushed into the barrel to such an extent that the projectile driving bands are seated firmly at the start of the barrel grooves. This can be done manually only with difficulty, particularly if the loading is to be carried out with a strong angle of inclination of the barrel, and there is the danger that the projectile will not be seated properly.

For this reason, ramming devices have already been designed in which the projectiles are pushed until held fast in the barrel rifling by means of a linearly guided hydraulically driven rammer. One such rammer is described in U.S. Pat. No. 3,120,785; this device has a hydraulic cylinder which is brought by means of a collapsible supporting device behind a projectile which has already been introduced into the chamber and is then actuated. The projectile is thereby imparted such force that after the completion of the movement of the piston it moves in free flight through the chamber and is seated fast at the beginning of the riflings.

However, the operating of this known ramming device is very cumbersome and time consuming. The device furthermore requires a relatively large amount of space behind the gun and (since it is not arranged on the elevatable parts of the gun) does not permit loading with a large elevation of the barrel.

The object of the present invention is to provide a projectile ramming device by means of which the kinetic energy necessary for free flight through the chamber is imparted to a projectile even in case of considerable elevation of the barrel which, while requiring only a small amount of space, brings the projectile far into the chamber. If a loading tray is provided for the projectile, the ramming device should be arranged in such manner that the projectile or shell is taken over by the ramming device from the end position of the loading tray.

This object is achieved in accordance with the invention by a ramming lever which engages behind the base of the shell and is driven in a swinging motion around a pivot which in its turn is moved along a circular path, and by a positive guiding of the two moving parts in such a manner that the end of the lever engaging the shell passes along a path which is at least approximately linear. With this construction one can obtain an optimally long guide path for the ramming lever with minimum extension of the members forming the device; preferably the ramming lever carried by the planet wheel of a planetary gear arrangement having a fixed sun wheel, the planet carrier being driven in rotation around the center of the sun wheel. An intermediate wheel is interposed between the sun wheel and the planet wheel to establish the proper direction of rotation of the planet wheel and allow the distance of the planet wheel from the sun wheel to be determined.

In principle, it is immaterial for the operation how the rotary drive of the planet carrier is produced. However, for considerations of space it is advantageous if the planet carrier is driven by a linearly moved rack which is in engagement with a toothed segment at the point of rotation of the planet carrier. The driving of the rack can be effected, for instance, by means of a hydraulic cylinder. The piston travel — by suitable selection of the transmission ratios — need of course only amount to a fraction of the length of the path of the ramming finger.

When a loading tray for the shells is present, all parts which form the ramming device can advantageously be arranged on the loading tray itself so that the swinging movement of the loading tray into the ramming position of the shell behind the breech of the gun is not impaired.

The invention will be described in further detail below with reference to the accompanying drawing which shows a preferred embodiment:

Figure 1:
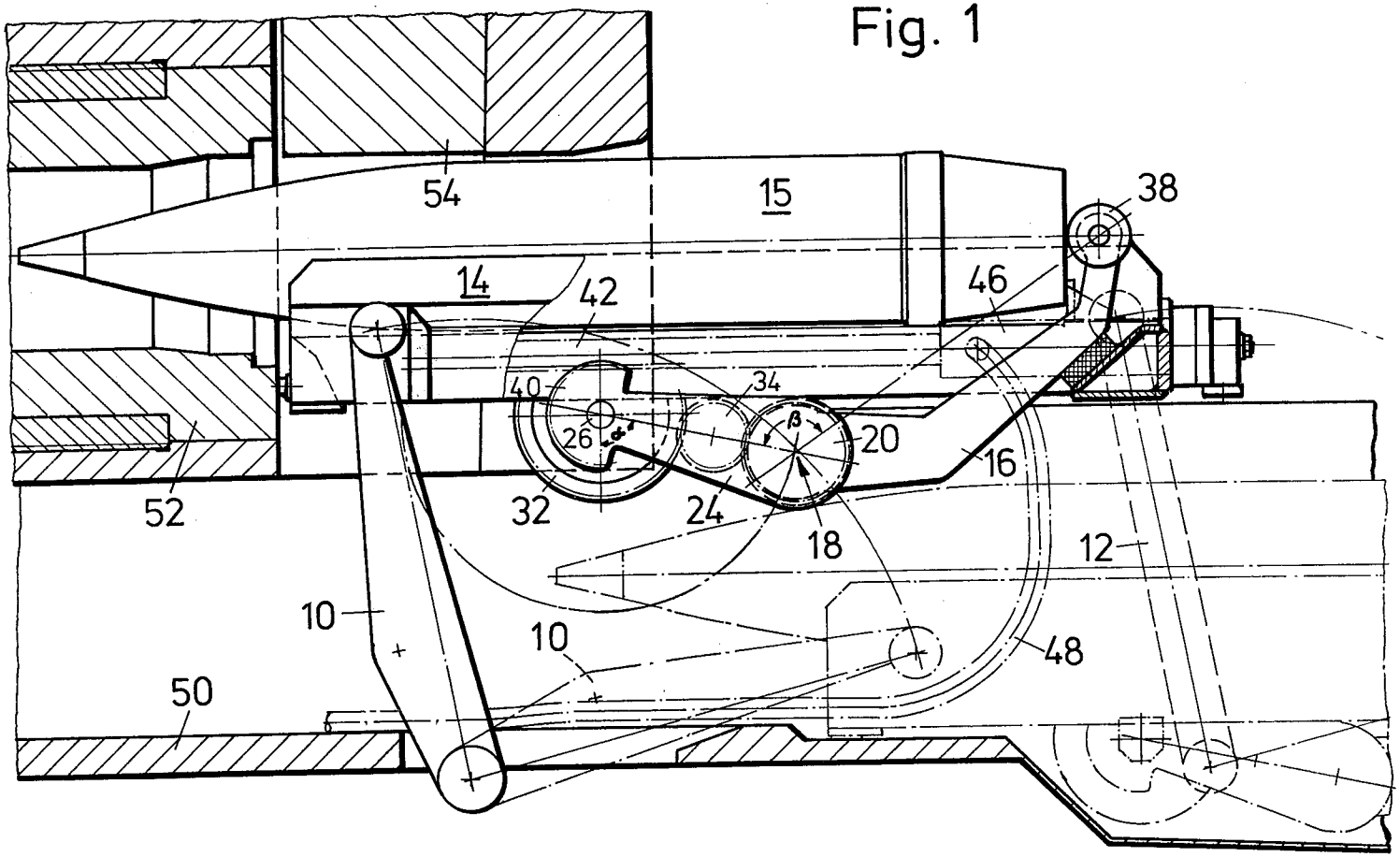
FIG. 1 shows semi-diagrammatically and partly in section a side view of a ramming device in accordance with the invention.

A parallelogram linkage having the levers 10, 12 brings a loading tray 14, on which the shell is lies, from the loading position indicated in dot-dash lines into the ramming position shown in solid lines (FIG. 1).

Figure 2:
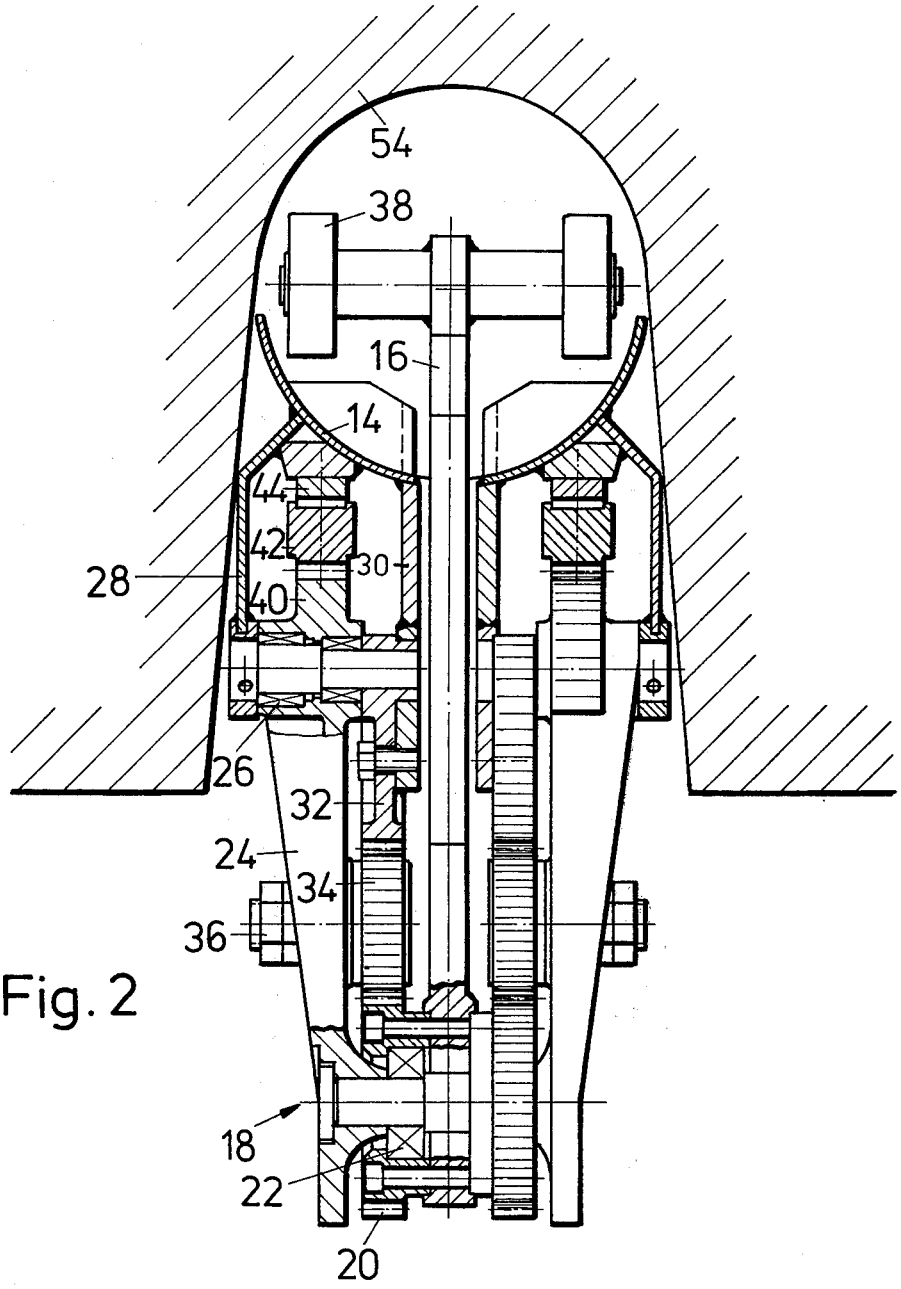
FIG. 2 shows the device of FIG. 1, partially in section, looking at the back of the breech.

The parts of the ramming device are arranged below the loading tray 14. As can be noted from FIG. 2, these parts — except for the ramming lever 16 itself — are present in pairs and are arranged symmetrically on both sides of the ramming lever. The ramming lever 16 is arranged for swinging around a pin 18 and is rigidly connected to a gear wheel 20. (Here and in the following in all cases only one of the double symmetrical parts present will be described; the other part of the pair is then positioned as a mirror image on the other side of the ramming lever). The corresponding swivel bearing 22 is located at the free end of an arm 24 whose other end is supported by bearing 26 in the loading tray.

The loading tray 14 is provided for this purpose with external ribs 28 on which the levers 10, 12 (not shown in FIG. 2) also act. Furthermore, internal ribs 30 are also welded below the loading tray 14, and a gear rim 32 is seated on them. This gear rim 32 forms the sun wheel of a planetary gearing whose planet carrier is the arm 24 and whose planet wheel is formed by the gear wheel 20. In order to obtain the desired direction of rotation, an intermediate wheel 34 is provided which meshes with the sun wheel (gear rim 32) and the planet wheel (gear rim 20) and is supported at 36 on the planet carrier (arm 24). The transmission ratio is so selected that upon rotation of the planet carrier from the position shown in FIG. 1 into its vertical position the connecting line is also vertical; this line is defined as connection of the axle 18 with the axle of a roller (or, as shown, a double roller) 38 which is supported on the free end of the ramming lever and engages behind the base of the shell 15. The ramming lever 16 has at this end a tapered section referred to as the ramming finger, which is somewhat bent at an angle. Accordingly, the ramming lever must pass through the angle "$\beta$" during the same time that the planet carrier passes through the angle "$\alpha$". With a proper selection of the distance between the axle 18 and the roller 38 the roller then moves along a relatively precisely straight path which is naturally parallel to the axis of the bore of the gun barrel.

Figure 3:
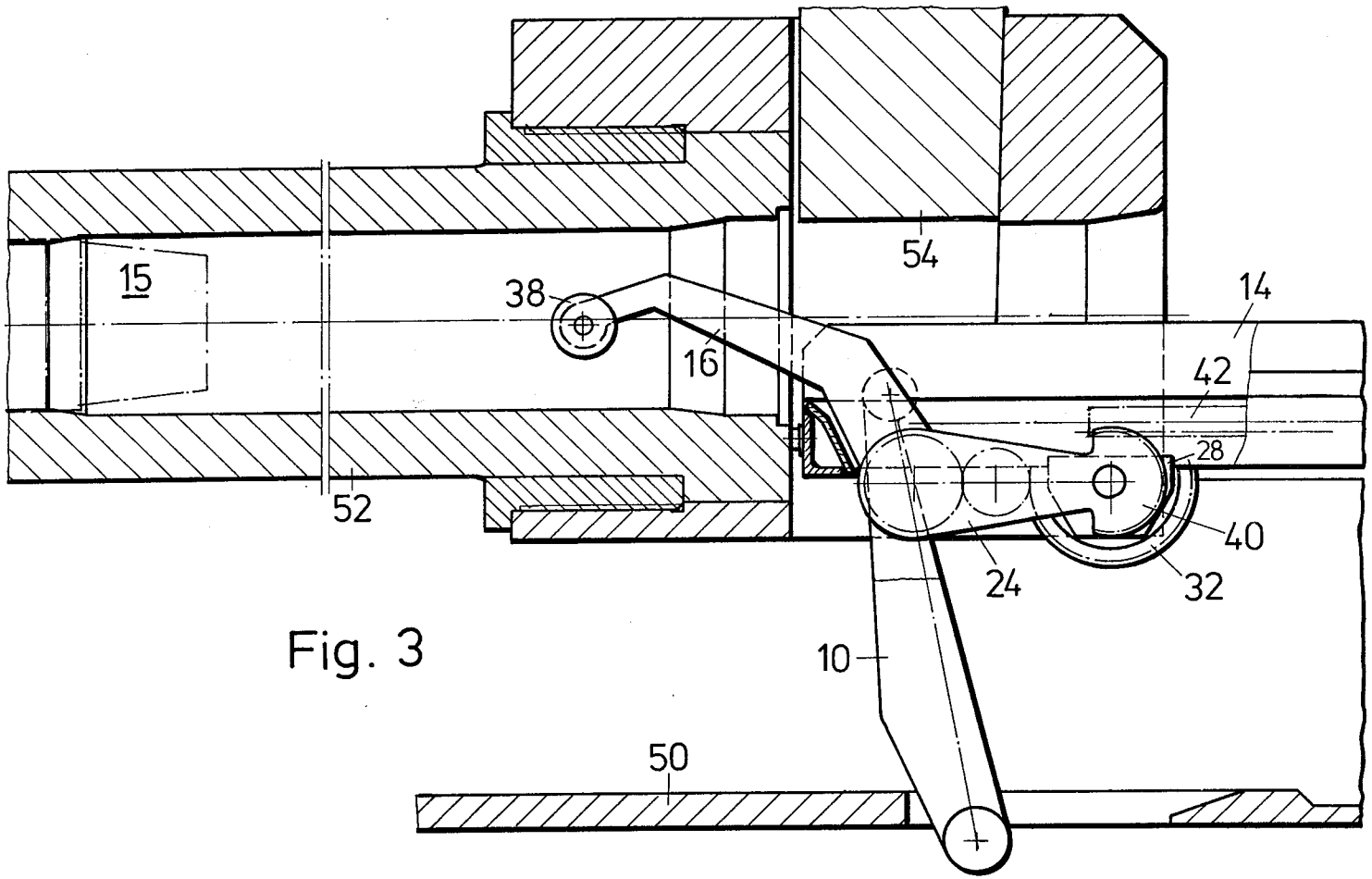
FIG. 3 shows diagrammatically the position of the ramming lever and of a shell after the ramming.

For the driving of the planet carrier the latter is connected with a toothed segment 40 which is in engagement with a rack 42. The side of the rack which is opposite the toothing is supported in the loading tray by means of a plain bearing 44. The piston rod of a hydraulic cylinder 46 which is provided with fluid under pressure via a line 48 shown in FIG. 1 acts on the end of the rack which faces away from the breech of the gun. The return of the ramming lever from the end position (FIG. 3) into the starting position (FIG. 1) can be effected by spring force or by reversing the hydraulic cylinder.

The line 48 is flexible since it must be guided on a fitting arranged permanently on the gun cradle (50) and therefore must be able to follow the swinging of the loading tray 14 into and out of the position shown in dot-dashed line in FIG. 1. On the cradle there is supported the barrel 52 (merely indicated in the drawing) having the breech body 54 and furthermore the levers 10, 12 bearing the loading tray.

I claim:

1. A shell loading tray for the loading chamber of a gun having a barrel axially aligned with said loading tray swingably mounted behind said chamber for carrying a shell into a position in which said shell is axially aligned with said barrel;

a pivot mounted on said loading tray for circular movement relative thereto about an axis offset from the axis of said pivot;

a ramming lever mounted on said pivot for circular movement about the axis of said pivot, said lever having a finger engaging behind said shell for displacing same in free flight through said chamber;

guide means for said pivot and said lever imparting substantially linear movement to said finger parallel to the axis of said barrel upon rotation of said pivot and said lever; and drive means for swinging said lever about said pivot and for swinging said pivot about said axis offset therefrom to propel said shell through said chamber.

2. A ramming device for shells by means of which the kinetic energy necessary for free flight through a chamber of a gun is imparted to a shell having a base, comprising a ramming lever engaging behind the base of said shell and driven in a swinging motion around a pivot point movable along a circular path, and means positively guiding said lever and said pivot point such that the end of said lever which acts on said shell passes along an at least approximately linear path parallel to the axis of the bore of a barrel of said gun, said ramming lever being seated on a planet wheel of a planetary gearing including a fixed sun wheel and a planet carrier of which is driven in rotation around the center of said sun wheel, an intermediate wheel being arranged between said sun wheel and said planet wheel.

3. The shell ramming device, as set forth in claim 2, wherein said planet carrier is driven by a linearly moved rack in engagement with a toothed segment at the point of rotation of said planet carrier.

4. The shell ramming device, as set forth in claim 2, wherein the parts forming the ramming device are arranged on a loading tray to be swung into the ramming position.

5. The shell ramming device, as set forth in claim 2, comprising a hydraulic drive for the movement of the ramming lever.

* * * * *